US007344380B2

(12) United States Patent
Neidlein et al.

(10) Patent No.: US 7,344,380 B2
(45) **Date of Patent: *Mar. 18, 2008**

(54) METHOD AND DEVICE FOR PRODUCING AN ELECTRICAL CONNECTION OF SUB-ASSEMBLIES AND MODULES

(75) Inventors: Hermann Neidlein, Steinheim (DE); Siegfried Schmidt, Koenigsbronn (DE)

(73) Assignee: Magcode AG, Heidenheim (DE)

( * ) Notice: Subject to any disclaimer, the term of this patent is extended or adjusted under 35 U.S.C. 154(b) by 212 days.

This patent is subject to a terminal disclaimer.

(21) Appl. No.: 10/527,479

(22) PCT Filed: Sep. 8, 2003

(86) PCT No.: PCT/EP03/09964

§ 371 (c)(1),
(2), (4) Date: Apr. 21, 2005

(87) PCT Pub. No.: WO2004/027937

PCT Pub. Date: Apr. 1, 2004

(65) Prior Publication Data

US 2006/0051981 A1 Mar. 9, 2006

(30) Foreign Application Priority Data

Sep. 13, 2002 (DE) ..... 102 42 645

(51) Int. Cl.
*H01R 11/30* (2006.01)

(52) U.S. Cl. ..... 439/39; 439/378; 439/374

(58) Field of Classification Search ..... 439/39, 439/378, 374, 38, 342

See application file for complete search history.

(56) References Cited

U.S. PATENT DOCUMENTS 682,126 A 9/1901 Carruthers et al.
3,521,216 A * 7/1970 Tolegian ..... 439/39
3,786,391 A * 1/1974 Mathauser ..... 439/39
4,716,722 A * 1/1988 Rambach ..... 60/39.83
4,853,830 A * 8/1989 Corfits et al. ..... 361/725
5,015,061 A 5/1991 Giannini
5,401,175 A 3/1995 Guimond et al.
5,431,570 A * 7/1995 Gibbs et al. ..... 439/39
5,466,171 A * 11/1995 Bixler et al. ..... 439/378
6,179,637 B1 * 1/2001 Lee et al. ..... 439/248
6,231,349 B1 5/2001 Bullinger et al.
6,551,123 B1 * 4/2003 Schaeffeler et al. ..... 439/374
6,561,815 B1 5/2003 Schmidt
2007/0072443 A1 * 3/2007 Rohrbach et al. ..... 439/39

FOREIGN PATENT DOCUMENTS

DE 199 30 642 A1 1/2001

(Continued)

OTHER PUBLICATIONS

US 6,264,473, 07/2001, Bullinger et al. (withdrawn)

*Primary Examiner*—Gary F. Paumen
(74) *Attorney, Agent, or Firm*—Davis Bujold & Daniels, P.L.L.C.

(57) ABSTRACT

The invention relates to a method for producing an electrical connection of sub-assemblies and modules to a current supply device, which is provided with electric contact elements and magnetic bodies. According to said method, magnetic bodies of a consumer, which is provided with electric counter-contacts, are arranged opposite the magnetic bodies of the current supply device with opposing poles. In a first step, a mechanical connection is made using an approximate guide mechanism and in a second step, electrical contact is made between the contact elements and the counter-contacts using a precise guide mechanism in an automatic manner by means of the magnetic bodies of the current supply unit and the consumer.

17 Claims, 1 Drawing Sheet

FOREIGN PATENT DOCUMENTS

Figure 1:
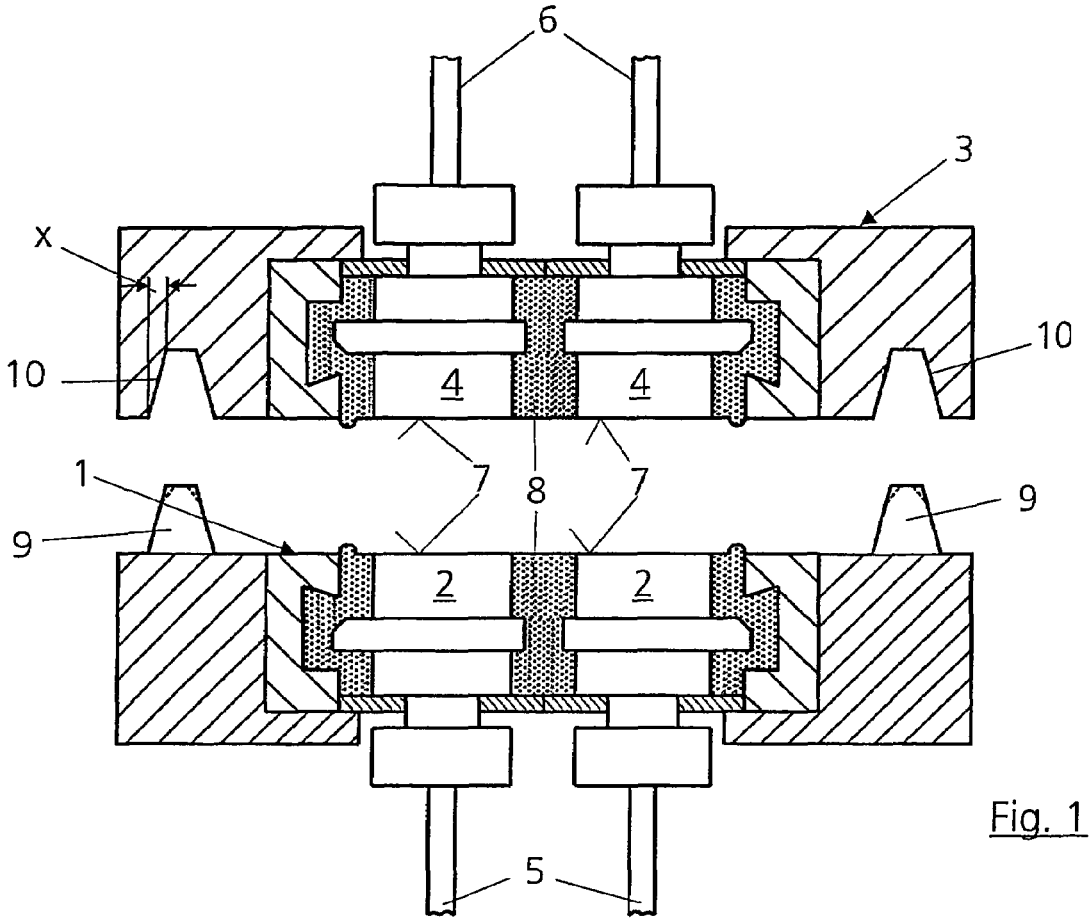

| | | |
|---|---|---|
| EP | 0 114 503 | 12/1983 |
| EP | 0 573 471 B1 | 2/1992 |
| WO | WO02/48449 | 6/2002 |

* cited by examiner

METHOD AND DEVICE FOR PRODUCING AN ELECTRICAL CONNECTION OF SUB-ASSEMBLIES AND MODULES

This application is a national stage completion of PCT/EP2003/009964 filed Sep. 8, 2003 which claims priority from German Application Serial No. 102 42 645.7 filed Sep. 13, 2002. The present Application is also related to U.S. Pat. No. 6,561,815 issued from U.S. patent application Serial No. 10/018,947, which is a national stage completion of PCT/EP00/06131 filed on Jun. 30, 2000 and claims priority from German Application Serial No. 199 30 642 filed Jun. 30, 2000, by common inventorship and common ownership.

The invention relates to a method for production of an electrical connection from assemblies and modules to a current transmitter unit, which is provided with electrical contact elements and with magnet bodies, and having a current receiver unit which is provided with electrical mating contact elements and with magnet bodies, which are arranged opposite one another, with opposite polarity to the magnet bodies in the current transmitter unit.

The invention also relates to an apparatus for carrying out the method.

PCT/EP 01/14503 describes an electromechanical connection apparatus in which an electrical connection is made between a current transmitter unit and a current receiver unit by magnetic forces. The current connection is in this case made by means of a moving magnet tray with contact points which are connected to current supply connections. In the rest state, that is to say when no current receiver unit with magnet bodies is fitted to the current transmitter unit, the magnet tray is held via a restraining device in the form of a permanent magnet at a distance from contact elements which are located on the upper face, or on the side facing the current receiver unit, of the current transmitter unit. As the current receiver unit is moved towards the current transmitter unit, a contact connection is made by closing the magnetic circuit between the magnet bodies in the current transmitter unit and those in the current receiver unit.

For simplicity, the expression magnet bodies is those in the current receiver unit.

For simplicity, the expression magnet bodies is referred to in a general form in the following text. In this case, these may be magnets, parts which can be magnetized or magnetic parts, which react magnetically under the influence of a magnet. The essential feature is that the magnet bodies in the current transmitter unit and those in the current receiver unit interact in such a way that a magnetic field creates a magnetic holding force on both parts.

WO 01/03249 A1 likewise describes an electromechanical connection apparatus in which two or more magnet elements and contact elements are arranged in one unit. One preferred field of use for the multiple contacts is the small or low-voltage range up to 24 volts, in order to control voltages, switching pulses or data transmission. In this case, at least one elastic wall, in which the contact elements are arranged, is provided in order to reinforce the contact connection, which is in the form of flat contacts. In this case as well, the electrical contact is made between a current transmitter unit and a current receiver unit for the separately arranged contact elements via the magnet elements.

EP 1 194 983 describes a mechanical connection apparatus in which an electrical connection is produced between a current transmitter unit and a current receiver unit via coded magnet elements.

The electrical connection apparatuses which have been described so far are used for quick and frequent connection of loads to a power source.

Until now, plug connectors have been used to produce electrical module connections which are intended for a lengthy period, for example in motor vehicle construction. Contact is in this case made via sockets and pins. In this case, in order to produce a better connection to the pins, which are generally turned or stamped parts, the sockets are provided with one or more springs per contact. The contact force and thus the electrical connection are produced via the spring force. The higher the spring force, the better is the transmission quality and the higher the currents which can be transmitted may be.

Another disadvantage is that fatigue may occur during the course of operation, resulting in the spring force becoming lower.

Currents of 30 amps and more are frequently transmitted via multipole plug connections in motor vehicle construction, as well as in other fields.

Owing to the high contact force which is required for transmission of high currents such as these, high forces are required in order to make the plug connection during the installation process, in order to minimize the contact resistance resulting from the sum of the contact forces of the individual contacts in multiway connectors. These forces may be up to 100 N or more. Technical aids frequently cannot be used for assembly installation since the installation space is too small and is thus poorly accessible. This means that the contact connection must be made by hand by a fitter so that a correctly made plug connection is dependent on the way in which the fitter works. Bad connections resulting from an incomplete insertion process therefore cannot be precluded owing to time pressure and working times with fatigue and the like. Inadequate connections lead to the plug connection becoming detached, and the transmission thus being interrupted, subsequently during operation. A further risk is that the fitter will improperly use aids, such as hammers and the like, to simplify his work in making the connection, which can result in damage to the plug connection.

The present invention is thus based on the object of providing a method and an apparatus for production of an electrical connection from assemblies and modules, by means of which the disadvantages described above are avoided, in particular by means of which a reliable connection is made, to be precise without having to rely on the reliability of a fitter.

According to the invention, this object is achieved in the case of an electrical connection method for assemblies and modules by the features specified in claim 1.

A connection apparatus for production of an electrical connection is described in claim 3.

According to the invention, the process of production of an electrical connection from assemblies and modules is split into two phases, to be precise:

In a first step, a mechanical connection is produced between the current transmitter unit and the current receiver unit, which connection can be made without application of large amounts of force and which can be produced reliably and without risk of confusion by virtue of an appropriate design of the connection elements.

Once the mechanical connection has been produced, an electrical contact is produced automatically, in a manner which can no longer be influenced by a fitter, with the contacts being oriented precisely with respect to one another, and with high contact forces.

This is made possible in this case by designing the mechanical connection such that, in its final position, the magnet bodies in the current transmitter unit and those in the current receiver unit are moved sufficiently towards one another that the magnetic attraction forces act between the individual magnet bodies. This then results in a switching process and thus in an electrical connection being made between the contact elements in the current transmitter unit and the mating contact elements in the current receiver unit. This means that assurance is always provided that a complete electrical connection will be made. The magnetic forces ensure a high degree of adhesion between the electrical contact elements and the mating contact elements, particularly when the magnet bodies at the same time represent the contact elements. If flat contacts are used for the contact elements, very high currents can be carried. This also applies in particular when—as envisaged—the power supply system in motor vehicles is increased to 42 volts.

If one wishes to avoid current being present on the contact elements of the current transmitter unit, which in fact are exposed on the upper face of the transmitter unit, when no current receiver unit is fitted, a magnet tray can be used as has been described, for example, in EP 0 573 471. At the same time, this allows on-load switching, in particular with high contact forces and a small number of contacts, as well.

If required, the magnet bodies can also be coded, as is described by way of example in EP 1 194 983. This avoids incorrect connections being made between contact elements and mating contact elements. This also applies to incorrect releasing in the presence of a magnetic switch. Furthermore, this results in even better positioning of the contacts with respect to one another.

Widely differing mechanical connections are possible for a first step to produce a mechanical connection. For example, it is possible for the current receiver unit to be pushed onto the current transmitter unit from the side, by means of an appropriate guide. Vertical fitting is likewise possible.

In addition to being pushed on or fitted from the side or vertically, a bayonet-like connection can also be provided. A latching connection in the final position, which may also be indicated audibly if required, is also possible.

Figure 2:
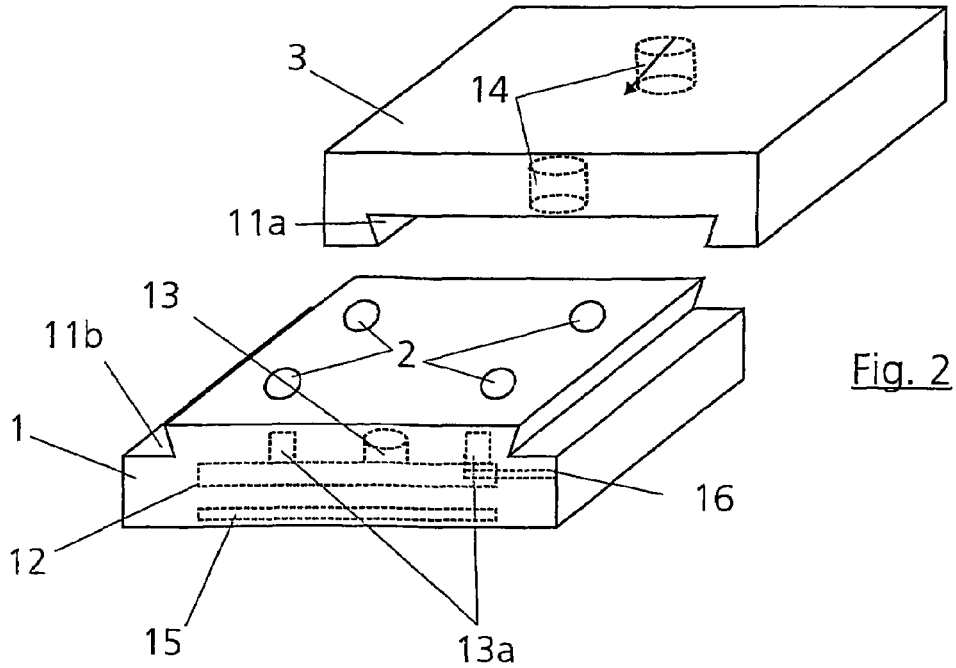

Advantageous developments and refinements result from the dependent claims and from the exemplary embodiments, whose fundamentals are described in the following text with reference to the drawing in which:

FIG. 1 shows a section through a current transmitter unit to which a current receiver unit is fitted, having an approximate guide for this purpose; and FIG. 2 shows, schematically, a perspective illustration of a current transmitter unit to which a current receiver unit is connected via a side guide as an approximate guide.

Two exemplary embodiments of the invention will be described in principle in the following text. Since the electrical connection apparatus via the magnet bodies of the current transmitter unit and those of the current receiver unit is already known in principle, in which context reference is made, for example to PCT/EP 01/14508, WO 98/09346, WO 97/50152 and WO 01/03249 A1, the following text describes in detail only those features which are significant for the invention.

A current transmitter unit 1 as illustrated in FIG. 1 and having contact elements 2 in the form of flat contents, and a current receiver unit 3 likewise having contact elements 4 in the form of flat contacts are described in detail, in terms of their design and their method of operation, in WO 01/03249 A1, and they will therefore not be described in any more detail here. WO 01/03249 A1 therefore also forms the disclosure content of the present application.

The contact elements 2 in the current transmitter unit 1 are at the same time in the form of switching magnets or magnetic switching parts, and the contact elements 4 in the current receiver unit 2 at the same time form releasing magnets or magnetic releasing parts. The contact elements 2 in the current transmitter unit 1 are each individually connected via cable connections 5 to a current, voltage or pulse source, which is not illustrated. A similar situation applies to the contact elements 4 in the current receiver unit 3, from which connecting cables 6 in each case lead to a load, which is likewise not illustrated. On their end faces 7 facing one another, the contact elements 2 and 4 are flat and are at least approximately flush with the respective surface of the associated unit 1 or 3. The contact elements 2 and 4 are each encapsulated in an elastic wall 8.

In the exemplary embodiment illustrated in FIG. 1, at least two truncated conical projections 9, which are arranged at a distance from one another, project out of the housing of the current transmitter unit 1 on the side facing the current receiver unit 3 which is to be fitted.

The current receiver unit 3 is provided in a manner complementary to this with truncated conical depressions 10 in the housing of the current receiver unit 3. The cone angle of the projection 9 and of the depression 10 are matched to one another for guidance. In contrast to "normal" conical guides such as these, however, oversize play is provided between the two guide parts, because the truncated conical projections 9 and the depressions 10 provide only approximate guidance. In addition, insertion inclines such as those illustrated by dashed lines in the head area of the truncated conical projections 9, can also be provided for this purpose, in order to ensure easy and reliable insertion and in order to take account of the unavoidable production and installation tolerances which, in the automobile field, may be 1 to 2 mm or more. The play is annotated by "X" in the cone angle on the current receiver unit 3. Clearance must likewise be provided between the head face of the projection 9 and the base of the depression 10 in order to allow the contact elements 2 and 4 to carry out the final, exact positioning and centering on the basis of their magnetic effect in the final insertion step after the current receiver unit 3 has been fitted to the current transmitter unit 1 and the projections 9 have been inserted into the depressions 10.

In order to avoid jamming and to simplify handling for the fitter, such play must be provided in any case in such a way that no jamming can occur during the connection of the current receiver unit 3 to the current transmitter unit 1 even with the maximum possible tolerance and production or installation inaccuracy that can occur.

Instead of a truncated conical projection and depression, it is also possible to provide other guide elements which allow approximate vertical guidance, within the scope of the invention, such as pins and holes, which may also have conical profiles, or pyramid-shaped connection elements and the like.

FIG. 2 shows, schematically, a connection of the current receiver unit 3 to the current transmitter unit 1 by being pushed on from the side. As can be seen, dovetail guides 11*a* and 11*b* are provided in the current transmitter unit 1 and in the current receiver unit 3 for side guidance and thus for pushing on from the side, in the direction of the arrow.

In contrast to dovetail guides 11*a* and 11*b* of a conventional type, it is also possible to provide oversize play between the two guides in this case, in order to make it possible to compensate for manufacturing and installation tolerances. In this case as well, the play should be at least 1 mm, and preferably 2 mm or even more.

Within the scope of the present invention, it is also, of course, possible to provide other design refinements of approximate guides instead of the two approximate guides with the truncated conical projections 9 and the depressions 10 matched to them, or the dovetail guides 11*a* and 11*b*. The only substantial feature is that, in a first step, a virtually force-free approach and connection are provided between the current transmitter unit 1 and the current receiver unit 3 in this way, after which exact positioning and centering are achieved by the magnetic effects of the contact elements 2 and 4 automatically and without being influenced by the fitter.

Within the scope of the invention, there is, of course, also no need for the contact elements 2 and 4 with the magnets to be identical. If the space conditions allow, magnets can also be provided independently of the contact elements 2 and 4 in the current receiver unit 3 and in the current transmitter unit 1.

In addition, FIG. 2 also shows, indicated by the dashed lines, an exemplary embodiment in which a magnet tray 12 is provided, which is provided with current supply contacts 16. In this case, separate magnets 13 and contact elements 13*a* are arranged on the magnet tray 12, with the contacts 13*a* being attracted by magnets 14 in the current receiver unit 3 during the fitting of the current receiver unit 3 to the current transmitter unit 1, together with the magnet tray 12, and in the process making contact with contact elements 2 from the rear. This results in a current connection. The details of the design and method of operation of this device are described, for example, in EP 0 573 471, which likewise forms the disclosure content of the present application.

In the rest state, that is to say when no current receiver unit 3 is fitted, the magnet tray 12 is attracted by a magnet 15 or a material composed of a magnetic substance which is located in the current transmitter unit 1 on the side facing away from the current receiver unit 3. In this state, there is thus no current on the contact elements 2, since the contact elements 13*a* are at a distance from them.

The invention claimed is:

1. A connection apparatus for establishing electrical connections between an electrical transmitter unit (1) and an electrical receiving unit (3), the connection apparatus comprising:

mating electrical contact elements (2, 4) located in corresponding opposing positions in the transmitter unit (1) and the receiver unit (3);

the contact elements (2, 4) being formed of magnetic bodies having opposing contact surfaces (7) and each pair of opposing contact elements (2, 4) having oppositely oriented magnetic fields whereby the magnetic fields of opposing contact elements (2, 4) interact to guide and attract the contact elements (2, 4) toward each other to form a contact between the contact surfaces (7) of each opposing pair of contact elements (2, 4); and a mechanical approximate positioning guide (9, 10 or 11*a*, 11*b*) including:

a first approximate positioning guide element (9 or 11*a*) on the transmitter unit (1) and corresponding and mechanically mating second approximate positioning guide element (9 or 11*a*) on the receiver unit (3) and a transmitter unit (1);

wherein a positioning tolerance between the first and the second positioning guide elements (9 or 11*a* and 10 or 11*b*) is sufficient to bring the magnetic fields of each opposing pair of contact elements (2, 4) into an attraction range of each other but is insufficient to bring the contact surfaces (7) of the contact elements (2, 4) into mechanical contact to form an electrical connection between the contact elements (2, 4), whereby the mechanical approximate positioning guide provides an initial positioning of the transmitter unit (1) and the receiving unit (3) to bring the magnetic fields of the opposing contact element (2, 4) into an interacting position and the magnetic fields of the contact elements (2, 4) provide a final alignment of the contact elements (2, 4) to bring the contact surfaces (7) of the contact elements (2, 4) into mechanical contact to form an electrical connection.

2. The connection apparatus as claimed in claim 1, wherein the flat contacts (2, 4) are arranged in an elastic wall (8) of the current transmitter unit (1) or of the current receiver unit (3).

3. The connection apparatus as claimed in claim 1, wherein the mechanical guide (9, 10 or 11*a*, 11*b*, respectively) is designed such that at the end of the mechanical insertion process, the magnet bodies in the current transmitter unit (1) and the magnet bodies in the current receiver unit (3) are arranged at least partially opposite one another.

4. The connection apparatus as claimed in claim 1, wherein the mechanical approximate guide has a side guide (11*a*, 11*b*) by which the current transmitter unit (1) is positioned above the current receiver unit (3).

5. The connection apparatus as claimed in claim 4, wherein the side guide is formed by connection elements in the form of dovetail guides (11*a*, 11*b*) in the current transmitter unit (1) and in the current receiver unit (3), with the dovetail guides (11*a*, 11*b*) has play.

6. The connection apparatus as claimed in claim 5, wherein the play is at least 1 mm at least in the direction of the current receiver unit (3) to be fitted.

7. The connection apparatus as claimed in claim 1, wherein the approximate guide has a vertical guide (9, 10) by means of which the current receiver unit (3) is fitted to the current transmitter unit (1).

8. The connection apparatus as claimed in claim 7, wherein the connection elements of the vertical guide are provided with oblique guides in the form of conical depressions (10) or projections (9).

9. The connection apparatus as claimed in claim 8, wherein the oblique guides (9, 10) are provided with play.

10. The connection apparatus as claimed in claim 9, wherein the play which is possible on the oblique guides (9, 10) is at least 1 mm.

11. The connection apparatus as claimed in claim 1, wherein the current transmitter unit (1) is provided with a magnet tray (12), which is provided with current supply contacts (16), with the magnet tray (12) being moveable in the direction of the current receiver unit (3) which is to be fitted, and with an electrical connection to the contact elements (2) being formed in the moved position.

12. The connection apparatus as claimed in claim 11, wherein the magnet tray (12) is provided with a restraining device (15).

13. The connection apparatus as claimed in claim 12, wherein the restraining device is provided with a magnet (15) or a material composed of a magnetic substance, which is arranged in the current transmitter unit (1) on the side facing away from the current receiver unit (3) which is to be fitted.

14. A method for establishing electrical connections between an electrical transmitter unit (1) and an electrical receiving unit (3), the method comprising the steps of:

performing an initial approximate positioning of the transmitter unit (1) and the receiving unit (3) to bring magnetic fields of opposing contact elements (2, 4) into an interacting position by means of a mechanical approximate positioning mechanism, including:

a first approximate positioning guide element (9 or 11*a*) on the transmitter unit (1) and corresponding and mechanically mating second approximate positioning guide element (9 or 11*a*) on the receiver unit (3) and a transmitter unit (1);

wherein a positioning tolerance between the first and the second positioning guide elements (9 or 11*a* and 10 or 11*b*) is sufficient to bring the magnetic fields of each opposing pair of contact elements (2, 4) into an attraction range of each other but is insufficient to bring the contact surfaces (7) of the contact elements (2, 4) into mechanical contact to form an electrical connection between the contact elements (2, 4); and performing a final alignment of the contact elements (2, 4) to bring contact surfaces (7) of the contact elements (2, 4) into mechanical contact to form an electrical connection by means of a magnetic final alignment mechanism, including:

the mating electrical contact elements (2, 4) located in corresponding opposing positions in the transmitter unit (1) and the receiver unit (3);

the contact elements (2, 4) being formed of magnetic bodies having opposing contact surfaces (7) with each pair of opposing contact elements (2, 4) having oppositely oriented magnetic fields whereby the magnetic fields of opposing contact elements (2, 4) interact to guide and attract the contact elements (2, 4) toward each other to form a contact between the contact surfaces (7) of each opposing pair of contact elements (2, 4).

15. The method as claimed in claim 14, wherein the current is supplied to the current transmitter unit (1) via a magnet slide (12) which is provided with electrical current supply contacts (13) and, after the first step is moved in the direction of the current receiver unit (3) after the first step with the mechanical connection by means of the magnet bodies (14) in the current receiver unit (3), thus making the electrical contact.

16. A connection apparatus for establishing electrical connections between an electrical transmitter unit (1) and an electrical receiving unit (3), the connection apparatus comprising:

mating electrical contact elements (2, 4) located in corresponding opposing positions in the transmitter unit (1) and the receiver unit (3);

the contact elements (2, 4) having opposing contact surfaces (7) and associated magnetic bodies with the magnetic bodies associated with each pair of opposing contact elements (2, 4) having oppositely oriented magnetic fields whereby the magnetic fields of the magnetic bodies associated with opposing contact elements (2, 4) interact to guide and attract the contact elements (2, 4) toward each other to form a contact between the contact surfaces (7) of each opposing pair of contact elements (2, 4); and a mechanical approximate positioning guide (9, 10 or 11*a*, 11*b*) including:

a first approximate positioning guide element (9 or 11*a*) on the transmitter unit (1) and corresponding and mechanically mating second approximate positioning guide element (9 or 11*a*) on the receiver unit (3) and a transmitter unit (1);

wherein a positioning tolerance between the first and the second positioning guide elements (9 or 11*a* and 10 or 11*b*) is sufficient to bring the magnetic fields of the magnetic bodies associated with each opposing pair of contact elements (2, 4) into an attraction range of each other but is insufficient to bring the contact surfaces (7) of the contact elements (2, 4) into mechanical contact to form an electrical connection between the contact elements (2, 4), whereby the mechanical approximate positioning guide provides an initial positioning of the transmitter unit (1) and the receiving unit (3) to bring the magnetic fields of the magnetic bodies associated with the opposing contact element (2, 4) into an interacting position and the magnetic fields of the magnetic bodies associated with the contact elements (2, 4) provide a final alignment of the contact elements (2, 4) to bring the contact surfaces (7) of the contact elements (2, 4) into mechanical contact to form an electrical connection.

17. A method for establishing electrical connections between an electrical transmitter unit (1) and an electrical receiving unit (3), the method comprising the steps of:

performing an initial approximate positioning of the transmitter unit (1) and the receiving unit (3) to bring magnetic fields of magnetic bodies associated with opposing contact elements (2, 4) into an interacting position by means of a mechanical approximate positioning mechanism, including:

a first approximate positioning guide element (9 or 11*a*) on the transmitter unit (1) and corresponding and mechanically mating second approximate positioning guide element (9 or 11*a*) on the receiver unit (3) and a transmitter unit (1);

wherein a positioning tolerance between the first and the second positioning guide elements (9 or 11*a* and 10 or 11*b*) is sufficient to bring the magnetic fields of the magnetic bodies associated with each opposing pair of contact elements (2, 4) into an attraction range of each other but is insufficient to bring the contact surfaces (7) of the contact elements (2, 4) into mechanical contact to form an electrical connection between the contact elements (2, 4); and performing a final alignment of the contact elements (2, 4) to bring contact surfaces (7) of the contact elements (2, 4) into mechanical contact to form an electrical connection by means of a magnetic final alignment mechanism, including:

the magnetic bodies associated with the mating electrical contact elements (2, 4) located in corresponding opposing positions in the transmitter unit (1) and the receiver unit (3);

the contact elements (2, 4) having opposing contact surfaces (7) and associated magnetic bodies with the magnetic bodies associated with each pair of opposing contact elements (2, 4) having oppositely oriented magnetic fields whereby the magnetic fields of the magnetic bodies associated with opposing contact elements (2, 4) interact to guide and attract the contact elements (2, 4) toward each other to form a contact between the contact surfaces (7) of each opposing pair of contact elements (2, 4).

* * * * *

UNITED STATES PATENT AND TRADEMARK OFFICE

CERTIFICATE OF CORRECTION

PATENT NO. : 7,344,380 B2
APPLICATION NO. : 10/527479
DATED : March 18, 2008
INVENTOR(S) : Hermann Neidlein and Siegfried Schmidt It is certified that error appears in the above-identified patent and that said Letters Patent is hereby corrected as shown below:

Column 1, lines 41-42

Please delete the sentence:

"For simplicity, the expression magnet bodies is those in the current receiver unit."

Signed and Sealed this

Thirtieth Day of March, 2010

David J. Kappos

David J. Kappos
*Director of the United States Patent and Trademark Office*